US005806104A

United States Patent [19]

Hand

[11] Patent Number: 5,806,104

[45] Date of Patent: Sep. 15, 1998

[54] TOILET DEODORIZING DEVICE UTILIZING LIQUID DEODORANT

[76] Inventor: William W. Hand, 4634 Locust St., Philadelphia, Pa. 19139

[21] Appl. No.: 697,391

[22] Filed: Aug. 27, 1996

[51] Int. Cl.[6] ..... A47K 13/00

[52] U.S. Cl. ..... 4/213; 4/209 FF

[58] Field of Search ..... 4/209 FF, 213, 4/228.1, 209

[56] References Cited

U.S. PATENT DOCUMENTS

| | | | |
|---|---|---|---|
| 4,117,559 | 10/1978 | Boyle . | |
| 4,209,864 | 7/1980 | Lindauer | 4/228.1 X |
| 4,876,748 | 10/1989 | Chun | 4/213 |
| 4,944,045 | 7/1990 | Agelatos et al. | 4/213 |
| 5,199,111 | 4/1993 | Antepenko . | |
| 5,231,705 | 8/1993 | Ragusa . | |
| 5,454,122 | 10/1995 | Bergeron . | |
| 5,488,741 | 2/1996 | Hunnicutt, Jr. . | |
| 5,491,847 | 2/1996 | Shaffer . | |
| 5,493,737 | 2/1996 | Chu | 4/213 |

*Primary Examiner*—Charles E. Phillips
*Attorney, Agent, or Firm*—Caesar, Rivise, Bernstein, Cohen & Pokotilow, Ltd.

[57] ABSTRACT

A bathroom deodorizing device for use with a conventional toilet bowl includes a housing having an inlet located between the rear of the toilet seat and the toilet bowl. The inlet captures offensive air which is drawn into the housing by a fan and into a deodorizing chamber. The chamber is in fluid communication with a first and second chamber. The first chamber contains a liquid deodorizer and the second may also contain a liquid deodorant and/or a liquid which is used to impart a desired fragrance into the air before it exits the device. As the air is bubbled into the liquid deodorizer contained in the first deodorizing chamber, the air is cleansed, purified and deodorized and enters the second chamber for a second process and is then released into the surrounding environment. The device includes a pressure activated switch to turn the device on.

4 Claims, 1 Drawing Sheet

FIG. 1
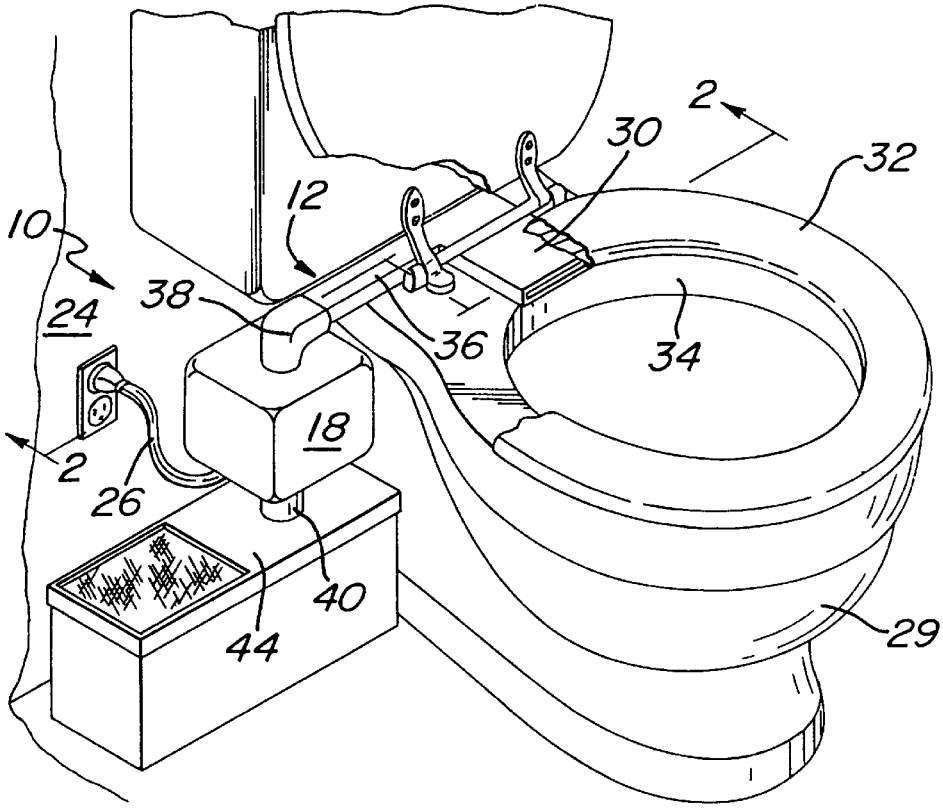
FIG. 3
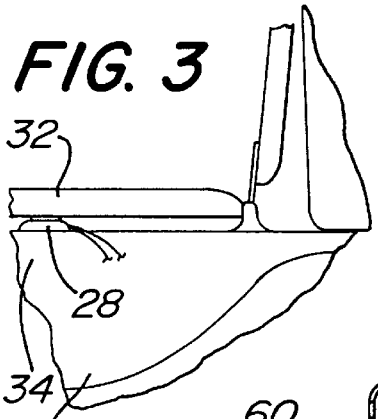
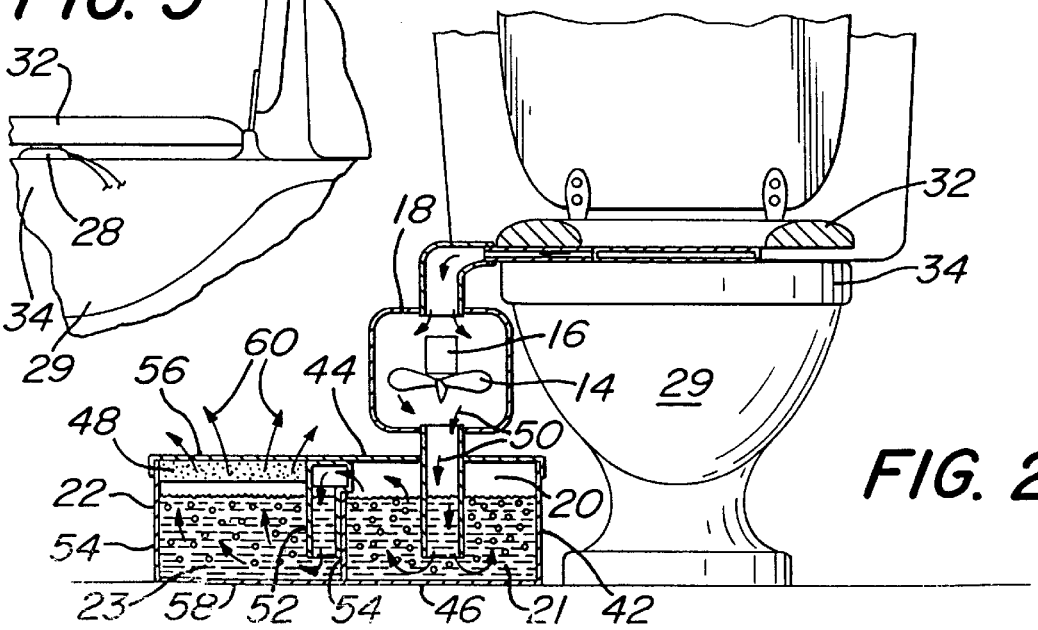
FIG. 2

TOILET DEODORIZING DEVICE UTILIZING LIQUID DEODORANT

BACKGROUND OF THE INVENTION

Oftentimes the air contained in a bathroom contains objectionable odors arising from the use of a toilet bowl. Devices in the past have attempted a solution to eliminate the offensive air in various ways. However, none of these devices known to the inventor have utilized a liquid deodorizer to cleanse, purify and deodorize the air in a bathroom environment as in the present invention. The present invention utilizes such a liquid deodorizer to achieve a superior level of air cleansing and deodorizing.

Various bathroom deodorizing devices have been known in the art and include the devices disclosed in U.S. Pat. Nos. 5,488,741, 5,454,122, 5,491,847, 5,231,705, 5,199,111 and 4,117,559. In examining these various United States patents it is believed that none of the above patents show the use of bubbling offensive air removed from a toilet into a liquid deodorant to cleanse the air. Some of the patents do disclose the use of dry filters, e.g., a charcoal filter or freshener granule to cleanse air adjacent a toilet.

Accordingly, a need exists for a toilet and bathroom deodorizing device utilizing a liquid deodorizer to be used in cleansing and purifying offensive air.

BRIEF SUMMARY OF THE INVENTION

A bathroom deodorizing device for use with a conventional toilet bowl including a housing having an inlet to be located between the rear of the toilet seat and the toilet bowl. The inlet captures offensive air which is drawn therethrough by a fan into a chamber. The chamber is in fluid communication with a first chamber containing a liquid deodorizer and a second deodorizing chamber containing either a liquid deodorizer and/or a liquid which imparts a desired fragrance to the air prior to its exit from the device. As the air is bubbled into each of the liquids, the air is cleansed, purified and/or deodorized and is released into the surrounding environment.

BRIEF DESCRIPTION OF THE DRAWINGS

Other objects and many attendant features of this invention will become readily appreciated as the same becomes better understood by reference to the following detailed description when considered in connection with the accompanying drawings wherein:

FIG. 1 is an isometric view of the deodorizing device of the present invention;

FIG. 2 is a front view of the deodorizing device of the present invention shown partially in section taken along line 2—2 of FIG. 1; and FIG. 3 is a side view of the pressure activated switch which activates the deodorizing device of the present invention.

DETAILED DESCRIPTION OF THE INVENTION

Referring now to various figures of the drawings where like reference numerals refer to like parts, there is shown at 10 in FIG. 1, a device constructed in accordance with this invention.

As shown in FIGS. 1 and 2, the device includes a housing 12, fan 14, a conventional motor 16 to drive the fan 14, a chamber 18 to house the fan 14 and motor 16, a first chamber 20 and a first liquid deodorizer 21 and a second chamber 22 and a second liquid 23. The fan 14 and motor 16 are connected to a power source 24 via a power cord 26 and can be activated by a pressure sensitive switch 28 as shown in FIG. 3, to turn on the fan 14 and motor 16 when a person is seated on a conventional toilet 29.

The housing 12 includes a housing inlet 30 located between the toilet seat 32 and toilet bowl rim 34 at the rear sections thereof to permit the entry of air to be deodorized into the housing 12. The housing 12 may be fixedly secured to the rim 34 by adhesive or other conventional means or may rest thereon depending upon the desired configuration.

Once the offensive air enters the housing inlet 30, it passes through a tubular member 36 which may be generally perpendicular to the inlet 30. A preferable size of the inlet is ½"×3"×5" and is preferably made of a high impact plastic such as polystyrene, or any other acceptable plastic, and may be rigid or flexible. It should also be appreciated that the size and location of the housing and other elements may be adjusted according to circumstances and needs.

The tubular member 36 may be also made of a flexible material such as a flexible plastic and is connected to a right angle coupling 38 which directs the air flow into the fan and motor chamber 18. The fan 14 and motor 16 then push the air out of the chamber 18 into a second tubular member 40 which is in fluid communication with the chamber 18 and in fluid communication with the first chamber 20. The chamber 18 may be made in a rectangular shape as shown or may be comprised of a tube approximately six inches in diameter and 12 inches long, depending upon the configuration desired and space limitations in the bathroom.

The first chamber 20 can be of any shape but is shown generally rectangular in shape having side walls 42, a cover 44 and a bottom 46. The cover 44 is shown as a unitary piece and there also acts as a cover for the second chamber 22 described herein, although separate covers for each of the chambers can be utilized if desired. Although many different types of deodorizers can be utilized as the first liquid deodorizer 21, a preferable deodorizer to be used is sold under the name ODOBAN, by the Clean Control Corp., P.O. Box 744, Warner Robbins, Ga. 31095, (912) 922-5340.

The liquid holding capacity of the first chamber 20 can vary depending upon the circumstances of use, the amount of use of the toilet 29 and the desire to minimize the necessity to replace and/or replenish the liquid deodorizer 21. By bubbling the offensive air as depicted by arrows 50 into a liquid deodorizer 21, the air is purified much more efficiently than in filters which utilize a dry type filter such as charcoal and the deodorizer imparts a pleasant scent to the air before it is released into the environment.

After the air is bubbled into the first liquid 21, it will then be forced into tubular member 52 which is in fluid communication with the second liquid chamber 22 containing a second liquid material 23.

The second chamber 22 can be of any shape but is shown generally rectangular in shape having side walls 54, a bottom 58 and the previously described cover 44. The portion of cover 44 which covers the second chamber also has openings 56 therethrough to release air from the system as depicted by the arrows 60.

As shown in FIG. 2, between the lid 56 and the liquid 23 is shown an open celled porous foam material 48 which minimizes bubbles being produced in the liquid 23 when the air, shown by arrows 50, is bubbled from the tubular member 52 into the second liquid 23. Preferably, the level of the second liquid 23 is of a height such that it does not touch the foam material 48. When the bubbles of the liquid 23 hit the foam material 48, the bubbles will burst, thus keeping the second chamber 22 from overflowing with bubbles. If desired, one may also utilize such a foam material at the top of the first chamber 20, if necessary, depending upon whether or not the liquid deodorant used in that chamber has a tendency to bubble when air is bubbled through it. In addition, if desired, a similar type of foam may be utilized in the tubular member 52 to prevent any bubbles from being introduced into the second chamber 22 from the first chamber 20.

Although many different types of liquids can be utilized as the second liquid 23, a preferable liquid to be used is sold by Mary Kay Cosmetics of Dallas, Tex., under the name Private Spa Aromatic Oil Collection and contains $C_{12-15}$alkyl benzoate, jojoba oils, fragrance, tocopherol and retinylpalmitate. As should be readily apparent to those skilled in the art, other similar types of materials may be used as the second liquid, depending upon the circumstances of use. Other aromatic oils and fragrances will also impart a pleasing fragrance to the air prior to its escape from the device 10. By keeping two separate liquid chambers with two different liquids therein, a heretofore unachieved level of air purity is obtained.

It is preferable to have two different liquid materials as described above, rather than a single liquid, so that a more efficient deodorizing process and fragrance-imparting process can occur. In addition, one can easily adjust the fragrance of the air released from the device 10, by utilizing two separate containers, rather than mixing liquids together in a single container, although it should be readily apparent to one skilled art, that depending upon the circumstances and conditions of use, one may wish to utilize a single liquid chamber.

As shown in FIGS. 1 and 3, the power source 24 used with the present invention to drive the fan 14 and motor 16 is a standard wall outlet AC power source which is electrically connected to the motor 16 by a conventional cord 26 and activated by conventional pressure activated switch 28. One type of conventional motor which can be used with the present invention is a type A 120 volt 1.9 amp AC motor whose shaft is connected to the fan blades 14. Alternatively, one may wish to operate the system by a battery power system, if desired.

In addition, if desired one may choose to replace the pressure activated switch 28 with a conventional photo sensor (not shown) to permit the device 10 to be activated. One may also choose to utilize the photo sensor as well as a pressure sensitive switch 28.

One of the many benefits of the present invention is that the device requires no modification to the existing toilet seat and lid and requires a minimum of parts to achieve a level of practicality and simplicity not previously achieved. The liquid deodorizer and fragrances are readily available and can easily be replenished and/or replaced as necessary.

Without further elaboration the foregoing will so fully illustrate my invention that others may, by applying current or future knowledge, adapt the same for use under various conditions of service.

I claim:

1. A bathroom and toilet deodorizing device for use with a conventional toilet bowl comprised of a toilet seat, toilet bowl and toilet bowl rim, the device comprising:

a) a housing means comprising, in fluid communication, an inlet located between the toilet seat and toilet bowl rim, the inlet being connected to a first tubular member, the first tubular member being connected to a coupling connected to a fan chamber for holding a fan and motor, a second tubular outlet member extending from the fan chamber into a deodorizing chamber, the housing further comprising a deodorizing chamber to contain a liquid deodorizer, the deodorizing chamber including outlet means to permit air to escape from the deodorizing chamber;

b) a motor connected to a fan to draw offensive air from the housing inlet, through the housing and into the deodorizing chamber; and c) a liquid deodorizer contained within the deodorizing chamber so that the offensive air drawn into the deodorizing chamber is bubbled into the liquid deodorizer to cleanse the air, wherein the deodorizing chamber comprises a first and second compartment for containing a liquid deodorizer, the first and second compartments being connected together in fluid communication by a tubular member, the first compartment comprised of a releasably securable lid, sidewalls and a bottom, the second compartment comprised of a releasably securable lid having air vents therethrough to permit air to escape from the device, sidewalls and a bottom.

2. The device of claim 1 further comprising a pressure-activated switch located between the toilet seat and the toilet bowl rim to activate the motor and fan when a person is seated on the toilet seat.

3. The device of claim 1 wherein the second compartment additionally comprises a foam material located therein adjacent the lid.

4. The device of claim 3 wherein the liquid in the first compartment is different than the liquid in the second compartment.

* * * * *